United States Patent [19]

Thompson

[11] 4,352,591

[45] Oct. 5, 1982

[54] PNEUMATIC TOROIDAL WEIR

[76] Inventor: Worthington J. Thompson, 109 Powell St., Snow Hill, Md. 21863

[21] Appl. No.: 177,089

[22] Filed: Aug. 11, 1980

[51] Int. Cl.[3] ..... E02B 7/00

[52] U.S. Cl. ..... 405/87; 210/170; 405/91; 405/115; 47/1.4

[58] Field of Search ..... 405/87, 91, 115; 210/170, 747; 47/1.4

[56] References Cited

U.S. PATENT DOCUMENTS

| | | | |
|---|---|---|---|
| 3,173,269 | 3/1965 | Imbertson | 405/87 |
| 3,834,167 | 9/1974 | Tabor | 405/115 |
| 3,855,800 | 12/1974 | Ganzinotti | 405/91 |

FOREIGN PATENT DOCUMENTS

| | | | |
|---|---|---|---|
| 2030624 | 4/1980 | United Kingdom | 405/115 |

*Primary Examiner*—Benoît Castel

*Attorney, Agent, or Firm*—Walter G. Finch

[57] ABSTRACT

The invention is an improved weir means for use in algae growing reactors in a controlled natural purification system for advanced waste water treatment and algae farming. The invention is a pneumatic device that eliminates the need for a mechanically operated lift-type rigid weir for controlling the level of liquids and increasing the algal concentration in an algae growing reactor and separation of suspended solids in the effluent therefrom. The pneumatic toroidal weir consists of a toroid or doughnut shaped means that can be inflated and deflated. The device rests in and is affixed to a circular ring-like base. The interior periphery of the toroid or doughnut configuration is convoluted to improve controlled inflation and deflation; to reduce interior overhang, and to increase toroidal height without increasing volume. Chines are set along and around the outer periphery of the toroidal weir to reinforce the outer wall and to inhibit settled or settling algae from "climbing" over the weir when liquid is decanted from the algae growth reactor in the algae separation mode.

1 Claim, 11 Drawing Figures

PNEUMATIC TOROIDAL WEIR

BACKGROUND AND SUMMARY OF THE INVENTION

The invention relates to wastewater treatment systems and in particular to wastewater treatment systems in which conversion of organic wastes and light energy to glucose takes place. Specifically, the invention relates to a complex system in which wastewater and other associated discharges are treated anaerobically and aerobically in a tank complex system where waste organics are reduced to inorganic forms available for algal culture in the uniquely designed rapid growth tanks.

This invention is an improved component of a pending application of the present inventor for a Controlled Natural Purification System for Advanced Wastewater Treatment and Protein Conversion and Recovery, Ser. No. 095,969, filed Nov. 20, 1979, now U.S. Pat. No. 4,267,038.

In the prior art, and in particular in the aforementioned pending application for a controlled natural purification system, the culture liquid in the last stage is controlled by a rigid vertically-moving circular weir.

The vertically-moving circular weir of the prior art is, by general description, a rigid cylindrical structure which is open at each end of the cylinder. The circular weir, when in position for operation, stands upright on one end. The circular-weir interfaces with the surrounding structure through gaskets.

The vertical movement of the vertically-moving rigid circular weir is provided by a cable suspension system attached to the rigid circular weir at specific points around the upper periphery of the weir. Electric motors lift the weir and lower the weir by means of reels for the cable suspension system.

The vertical movement of the rigid circular weir controls the depth of the culture liquid in the algae growth reactor. By lowering the weir the algae-free liquid is decanted over the top of the rigid circular weir. By moving the rigid circular weir slowly, settling algae is retained in the algae growth reactor, during algae separation (including harvesting) procedure. When the rigid circular weir is raised, the algae growth reactor may be filled again with more culture liquid for the growing of more algae.

The present invention is an improvement over the heavy vertically-moving rigid circular weir, which is also subject to some leakage at the gaskets mentioned previously. The present invention provides a toroidal shaped inflatable type of weir that has a more or less permanent interface connection which is water-tight. The inflation and deflation of the inflatable weir controls the culture liquid in the algae growth reactor as will be described hereinafter.

The present invention provides a pneumatic toroidal weir. The toroidal weir being more or less doughnut shaped as will be described hereinafter.

It is, therefore, an object of the invention to provide a toroidal shaped weir for controlling the culture liquid in an algae growth reactor, and for separating the algae from the effluent and increasing the concentration of the algae.

It is another object of the invention to provide a toroidal shaped weir that is inflatable.

It is also an object of the invention to provide a toroidal shaped weir that has a more or less permanent type connection to the algae growth reactor to prevent leakage.

It is still another object of the invention to provide a toroidal shaped weir that does not require a cable system to operate it.

Further objects and advantages of the invention will become more apparent in the light of the following description of the preferred embodiments.

DESCRIPTION OF THE PREFERRED EMBODIMENTS

Figure 1:
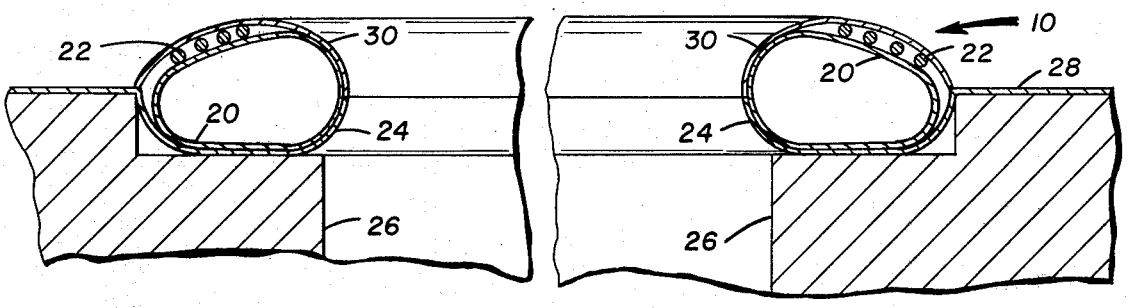
FIG. 1 is a partial cross sectional view through a control unit well of an algae growth reactor, showing a first embodiment of an inflatable weir in the fully inflated position with algae tank empty.
Figure 5:
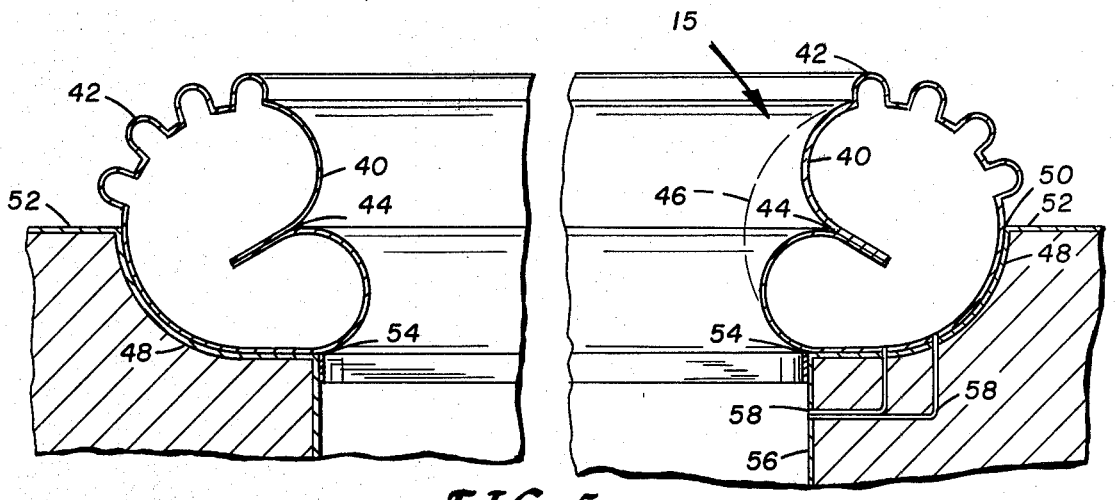
FIG. 5 is a partial cross sectional view through a control unit of an algae growth reactor, showing a second embodiment of an inflatable weir in the fully inflated position, with algae tank empty.

Referring to the drawings and particularly to FIGS. 1 and 5, a first embodiment of an inflatable weir is shown at 10 in FIG. 1 and a second embodiment of an inflatable weir is shown at 15 in FIG. 5. Inflation may be by air or any other gas pumped into the inflatable weir 10 or 15 by a suitable connection by piping.

The inflatable weirs 10 and 15 are both pneumatic weirs, both are inflated by air being pumped into them. The inflatable weirs 10 and 15 are both toroidal weirs, both are of an elastic membrane-like material, and both are more or less doughnut shaped, a toroid.

In addition, the inflatable weir 15 has several convolutions 44 on the inside periphery, as will be described hereinafter, so that it is a pneumatic convoluted toroidal weir. The inflatable weir 15 is the preferred embodiment. It is to be understood that although a plurality of only several convolutions 44 are shown for the inflatable weir 15, that a greater plurality is within the scope and intent of this invention.

The inflatable weirs 10 and 15 both have a plurality of chines or ridges 22 and 42 respectively in concentric formation around the toroidal inflatable weirs 10 and 15. Four chines or ridges 22 and 42 respectively are shown, however, it is to be understood that a greater or lesser number of chines or ridges 22 is within the scope and intent of this invention. The chines or ridges 22 and 42 are semi-rigid material.

It is also to be understood that the cross sectional configurations shown for inflated weirs 10 and 15 may be varied, including a simple circular cross section to a more or less square configuration, and with a weighted means, not shown, on the interior of the inflated weir to aid in the deflation process, are all within the scope and intent of this invention.

Describing now the first embodiment of an inflatable weir 10, the inflated weir 10 consists of a tube-like toroidal structure 20, having a plurality of chines or ridges 22 in concentric formation around an outer portion of the tube-like toroidal structure 20.

The inflatable weir 10 rests or is located in a circular dish-like container 24 that surrounds the control tank or unit well 26 of an algae growth reactor, and interfaces at the outer periphery of the circular dish-like container 24 with the floor 28 of the algae growth reactor. The dish-like container 24 may be made of plastics, metal, concrete, or any other suitable material anchored in place.

Figure 2:
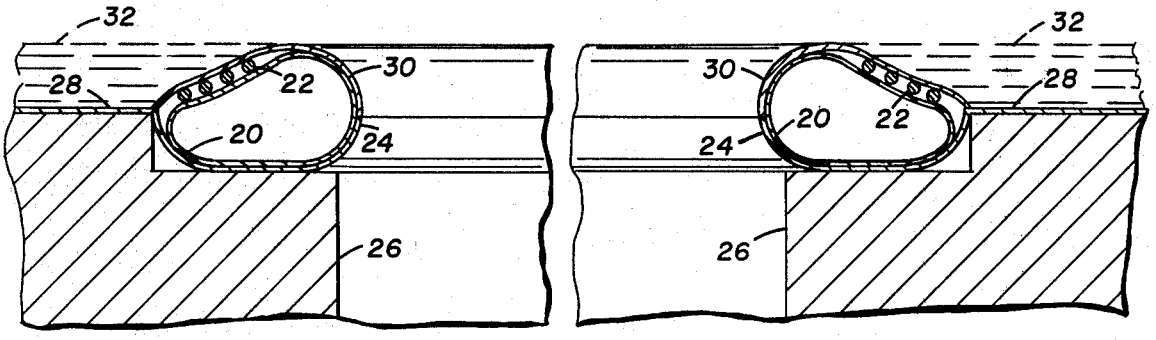
FIG. 2 is a partial cross sectional view through a control unit well of an algae growth reactor, showing a first embodiment of an inflatable weir in the inflated position, with algae tank filled.

An elastic curtain 30, affixed to the top or upper edges of the circular dish-like container 24 holds the inflatable weir 10 in position in the circular dish-like container 24. When the inflatable weir 10 is fully deflated, as in FIG. 4, the elastic curtain 30 is stretched across the circular dish-like container 24 so that the liquid or algae culture medium 32 of the algae growth reactor may flow across it and into the control unit well 26. As the inflatable weir 10 is progressively inflated, as in FIGS. 3 and 2 or 1, the elastic curtain stretches as illustrated and holds the inflated tube-like toroidal structure 20 in place in the circular dish-like container 24.

A disadvantage to this configuration is that the chines or ridges 22 are shielded from the liquid 32, and particularly when the liquid 32 is supporting algae. The more or less smooth surface of the elastic curtain 30 is not conducive to assisting in retaining the algae in the algae growth reactor as the liquid 32 is decanted. An improvement to this embodiment will be found in the second embodiment, as hereinafter described, which overcomes this disadvantage.

FIG. 1 shows the inflatable weir 10 fully inflated, the configuration illustrates the contour when the algae growth reactor is empty. When the liquid or algae culture medium 32 is in the algae growth reactor, the inflatable weir 10 has a cross sectional contour as in FIG. 2.

Figure 3:
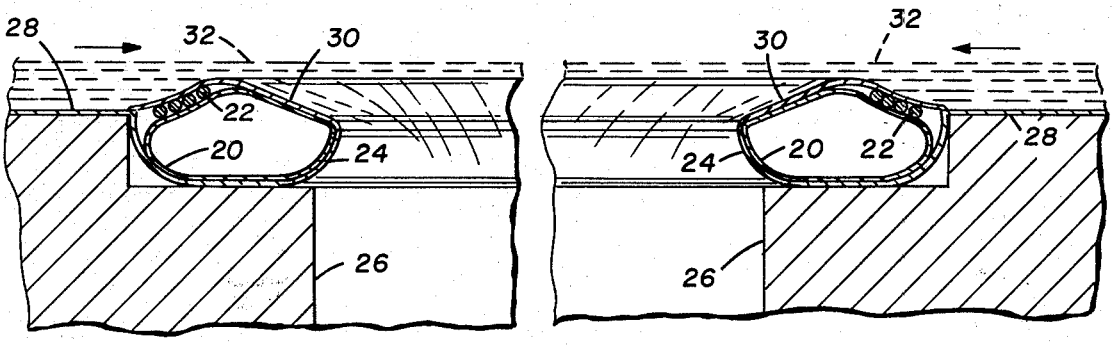
FIG. 3 is a partial cross sectional view through a control unit well of an algae growth reactor, showing a first embodiment of an inflatable weir partially deflated to decant liquid from the algae growth reactor.
Figure 4:
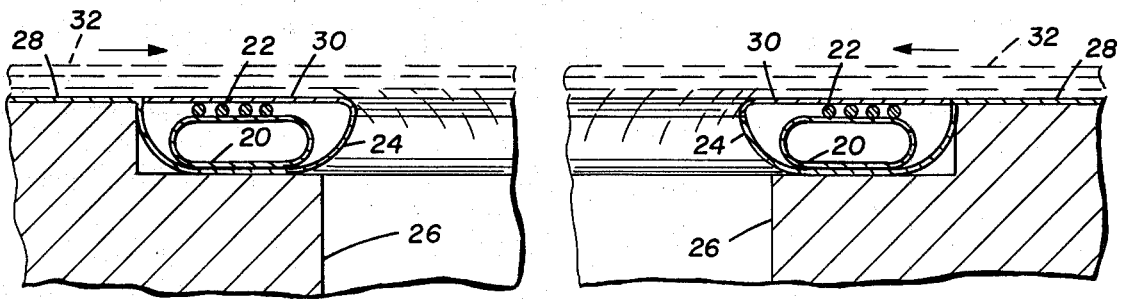
FIG. 4 is a partial cross sectional view through a control unit of an algae growth reactor, showing a first embodiment of an inflatable weir fully deflated for algae removal from the algae growth reactor.

When decanting of the liquid 32 begins by deflating the inflatable weir 10, the inflatable weir 10 changes configuration to the cross section seen in FIG. 3, and ultimately to the fully deflated cross section as shown in FIG. 4 and as referenced previously.

Inflation and deflation of the inflatable weir 10 are controlled by valves and connected piping or tubing. It is to be understood that the inflating and deflating may be automated including sensors regarding water depth in back of the inflatable weir 10.

Figure 6:
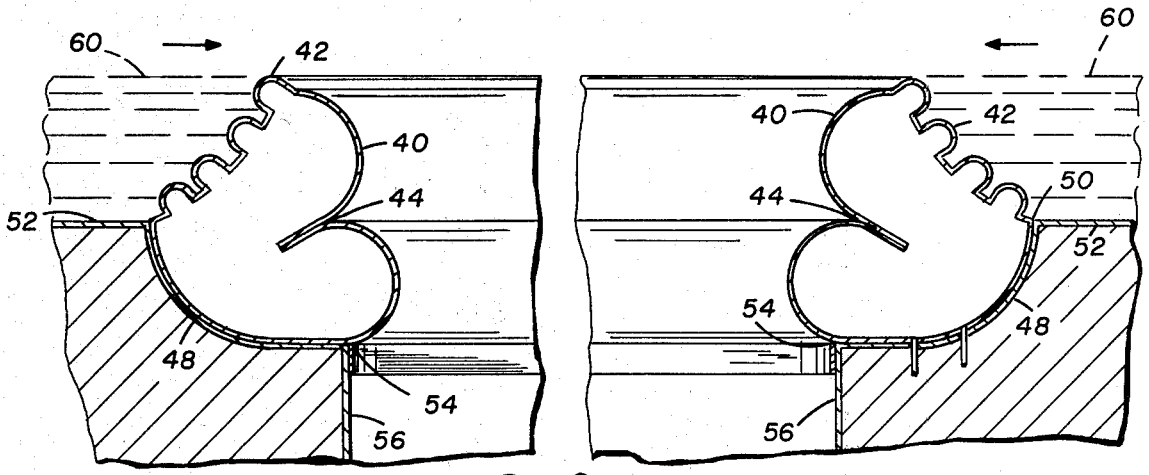
FIG. 6 is a partial cross sectional view through a control unit well of an algae growth reactor, showing a second embodiment of an inflatable weir in the inflated position, with algae tank filled.
Figure 7:
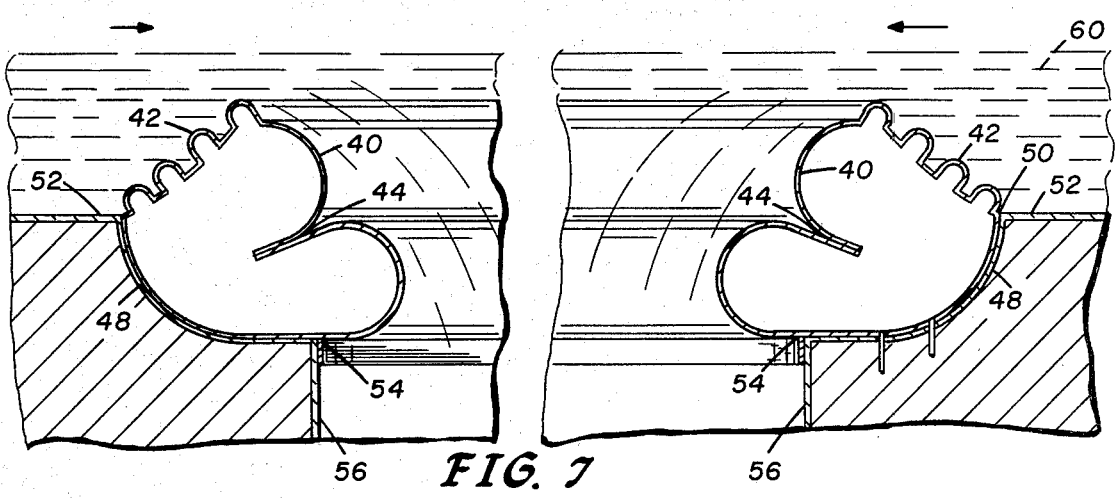
FIG. 7 is a partial cross sectional view through a control unit well of an algae growth reactor, showing a second embodiment of an inflatable weir, partially deflated to decant liquid form the algae growth reactor.
Figure 8:
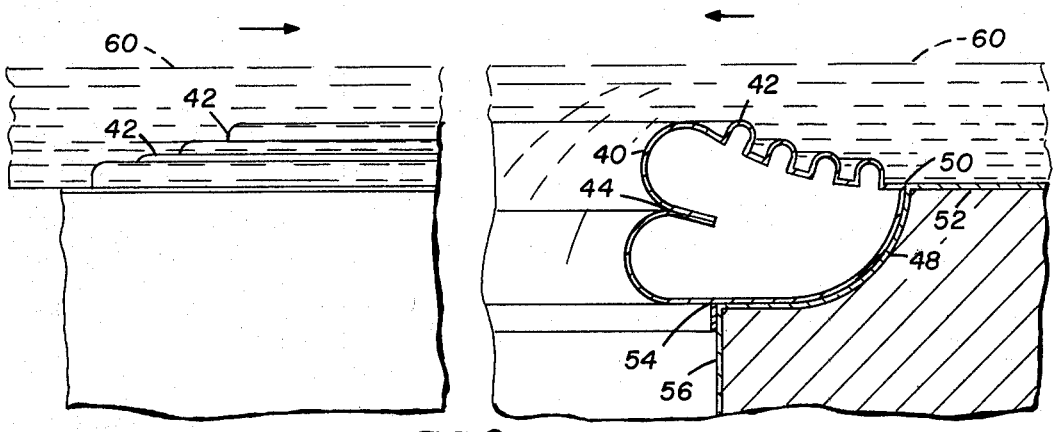
FIG. 8 is a continuation of deflation of second embodiment of inflatable weir in FIG. 7.
Figure 9:
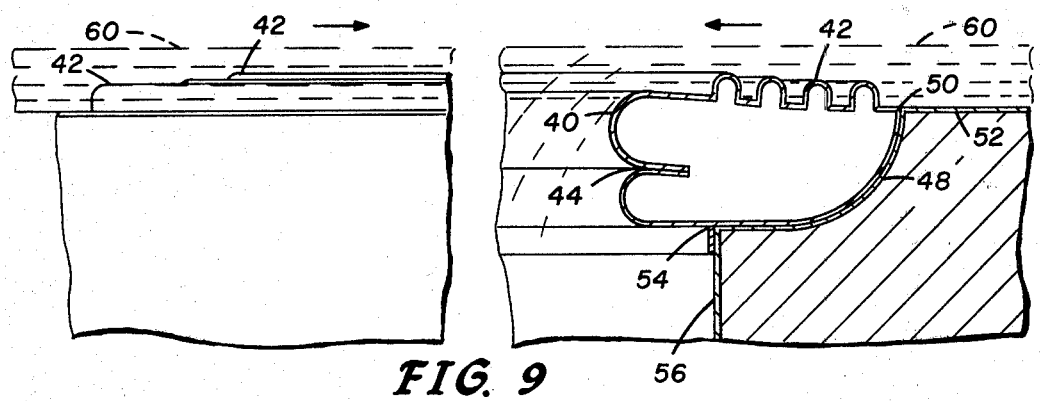
FIG. 9 is a continuation of deflation of second embodiment of inflatable weir in FIG. 8.
Figure 10:
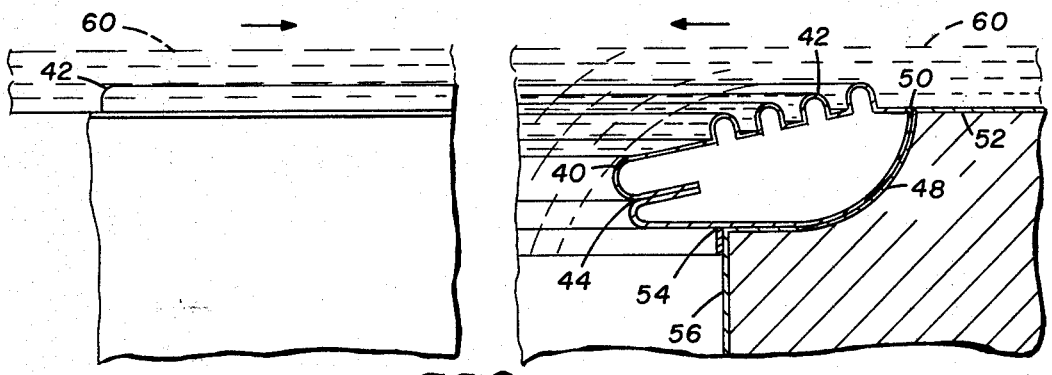
FIG. 10 is a continuation of deflation of second embodiment of inflatable weir in FIG. 9.

Turning now to the second embodiment of an inflated weir 15, the inflated weir 15 is shown in FIG. 5 with the algae growth reactor empty and in FIG. 6 with the algae growth reactor filled.

The second embodiment of an inflatable weir 15 consists of a convoluted tube-like toroidal structure 40, having a plurality of chines or ridges 42 in concentric formation around an outer portion of the convoluted tube-like toroidal structure 40.

The inflatable weir 15 has a plurality of convolutions 44. The convolutions reduce the inflatable volume, but do not reduce the height. In addition, the convolutions provide a strength or rigidity to the inflatable weir 15. The normal shape of an inflatable weir 15 without convolution 44 is shown in FIG. 5 by the dotted line 46, the reduced inflatable volume can be seen in the space between the dotted line 46 and the outer surface of the convoluted structure 40.

The inflatable weir 15 rests or is located in a circular half-dish-like holder or housing 48. The inflatable weir 15 is affixed or anchored to the holder 48 along the outer periphery of the edge 50 thereof and sealed along the entire edge 50 at the juncture with the algae growth reactor floor 52. The holder or housing 48 may be plastics, metal, concrete or other suitable material anchored in place.

The inflatable weir 15 may also be affixed to and sealed along the inner periphery edge 54 at the interface with the control tank or unit well 56 of an algae growth reactor.

Piping 58 to the inflatable weir 15 may be installed at any convenient location, one such arrangement is shown in FIG. 5.

Culture liquid 60, containing algae, is held in the algae growth reactor by the inflatable weir 15. As the inflatable weir 15 is deflated progressively, as in FIGS. 7, 8, 9, and 10, the chines or ridges 42 serve to impede the upward movement of settled algae and inhibit the climb of settling suspended solids at the liquid 60—weir 15 interface. The chines or ridges 42 also increase the weir height but not the inflatable volume. The chines or ridges 42 are concentric semi-rigid members on the flexible membrane of the convoluted tube-like structure 40.

It is to be noted that the various operational sequences of an algae growth reactor require the operation and use of an inflatable weir 10 or 15. Among such processing steps is the simultaneous function of separation of algae from final effluent and concentration of the algal suspension in the reactor. The capability for increasing the algal concentration in the culture medium is required for improved growth and it is also required in the harvesting procedure. Algae separation and concentration is achieved while algae settles in the quiescent culture medium, permitting algae-free effluent to be progressively decanted by deflation of the inflatable weir 15 until it is approximately at the stage shown in FIG. 8 or in FIG. 9.

Figure 11:
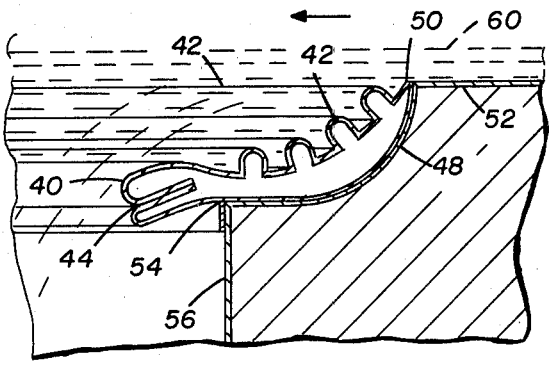
FIG. 11 is a continuation of deflation of second embodiment of inflatable weir in FIG. 10 to nearly fully deflated stage.

It is also to be noted that one method of a successive harvesting step is to completely drain the algae growth reactor. This can be done by completely deflating the pneumatic toroidal weir FIG. 11, and processing the concentrated algal suspension through the control tank or unit of the algae growth reactor and providing for continued algae harvest through a second concentration tank utilizing the inflatable weir 10 or 15 in a control unit or tank, repeating the procedure to achieve a tertiary concentration if necessary. Further steps of dewatering and drying in the harvesting process are not a part of this invention, but are mentioned here for illustrative purposes.

The inflating and deflating of an inflatable weir 10 or 15 may be automated and tied to the operation of an algae growth reactor by a water-depth sensor for automated decanting.

As can be readily understood from the foregoing description of the invention, the present structure can be configured in different modes to provide the ability to serve as a weir in a control unit or tank of an algae growth reactor.

Accordingly, modifications and variations to which the invention is susceptible may be practiced without departing from the scope and intent of the appended claims.

What is claimed is:

1. A pneumatic convoluted toroidal weir, comprising:

a tube-like structure formed of an elastic membrane-like material, said tube-like structure being convoluted and toroidal in configuration;

a plurality of chines constructed of a semi-rigid material, said chines being concentric with each other around said tube-like structure and affixed to a portion of the outer surface of said tube-like structure;

a plastic holder means, said holder means being half-dish-like and circular and sized to hold said tube-like structure therein;

a connecting means, said connecting means attaching said tube-like structure to said holder means;

a piping means, said piping means connected to said tube-like structure for inflation and deflation.

* * * * *